United States Patent [19]

Johnson

[11] 4,302,887

[45] Dec. 1, 1981

[54] VENEER BLOCK MOISTURIZING APPARATUS

[75] Inventor: Jerry Johnson, Drain, Oreg.

[73] Assignee: Jerry Johnson Mill Construction, Inc., Eugene, Oreg.

[21] Appl. No.: 129,478

[22] Filed: Mar. 11, 1980

[51] Int. Cl.[3] ..... F26B 9/06

[52] U.S. Cl. ..... 34/13.8; 34/16.5; 34/242; 110/173 R; 144/327; 134/102

[58] Field of Search ..... 34/13.4, 13.8, 16.5, 34/242, 46, 47, 72, 32; 68/5 E; 432/250; 110/173 R; 144/271, 327; 134/102

[56] References Cited

U.S. PATENT DOCUMENTS

| | | | |
|---|---|---|---|
| 1,328,657 | 1/1920 | Fish, Jr. | 34/9.5 |
| 1,480,804 | 1/1924 | Fish, Jr. | 34/9.5 |
| 2,953,108 | 9/1960 | Kelsen | 110/173 R |
| 3,583,690 | 6/1971 | Borner | 432/250 |
| 4,054,411 | 10/1977 | Beck | 110/173 R |
| 4,207,064 | 6/1980 | Taniguchi | 432/250 |

*Primary Examiner*—Larry I. Schwartz

*Attorney, Agent, or Firm*—Kolisch, Hartwell & Dickinson

[57] ABSTRACT

A veneer block moisturizing vault which has a single upright openable end which is closeable and exposeable through vertical shifting of a rigid unitary door. The lateral margins of the door are received in confronting channels, which, together with the door's margins, provide an effective lateral moisture barrier inhibiting the escape of steam from the vault when its door is closed. With the door closed, the bottom edge of the same rests snugly upon a specially prepared cement apron—also to effect a steam-capturing moisture barrier. Moisturizing in the vault is accomplished through the controlled blending and injection thereinto of steam and cold water.

4 Claims, 8 Drawing Figures

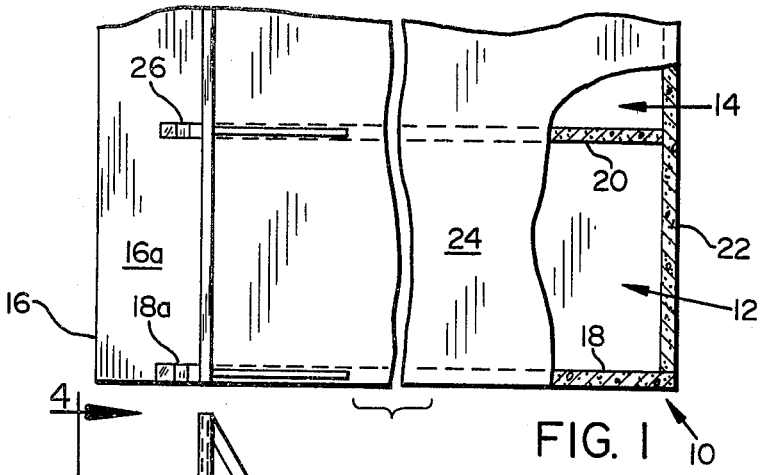
FIG. 1
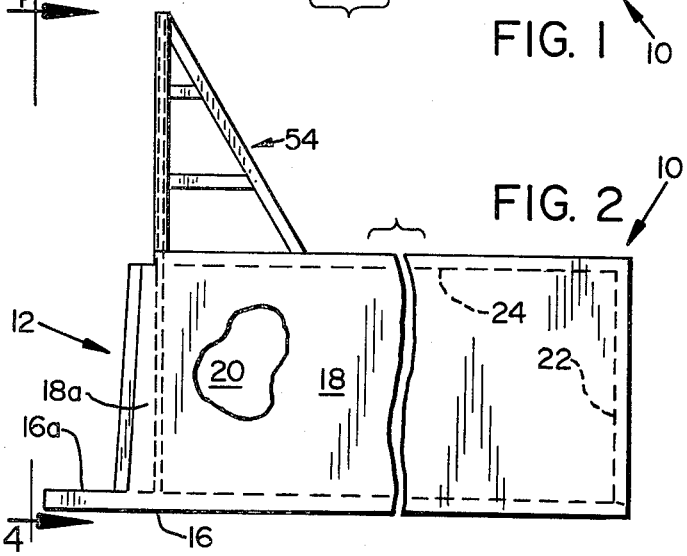
FIG. 2
FIG. 6
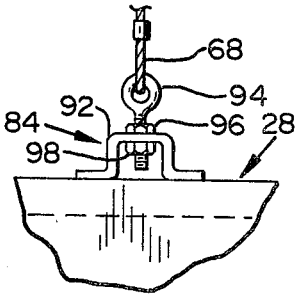
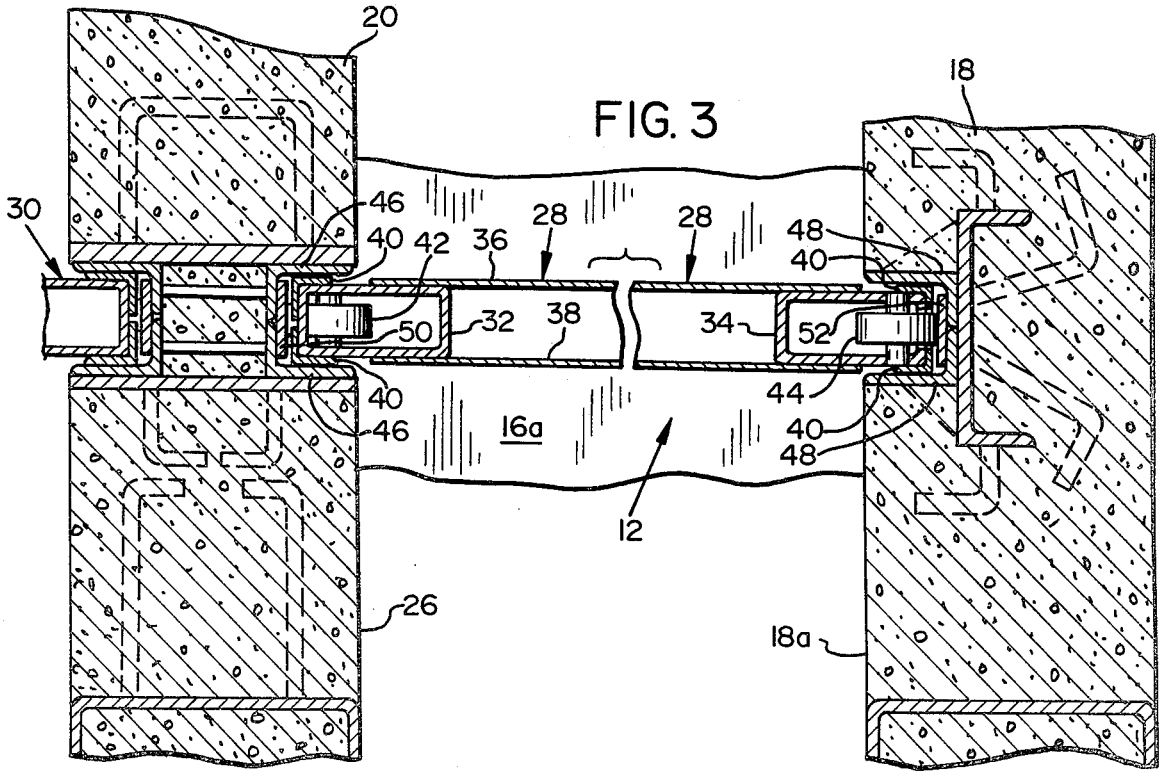
FIG. 3

FIG. 4
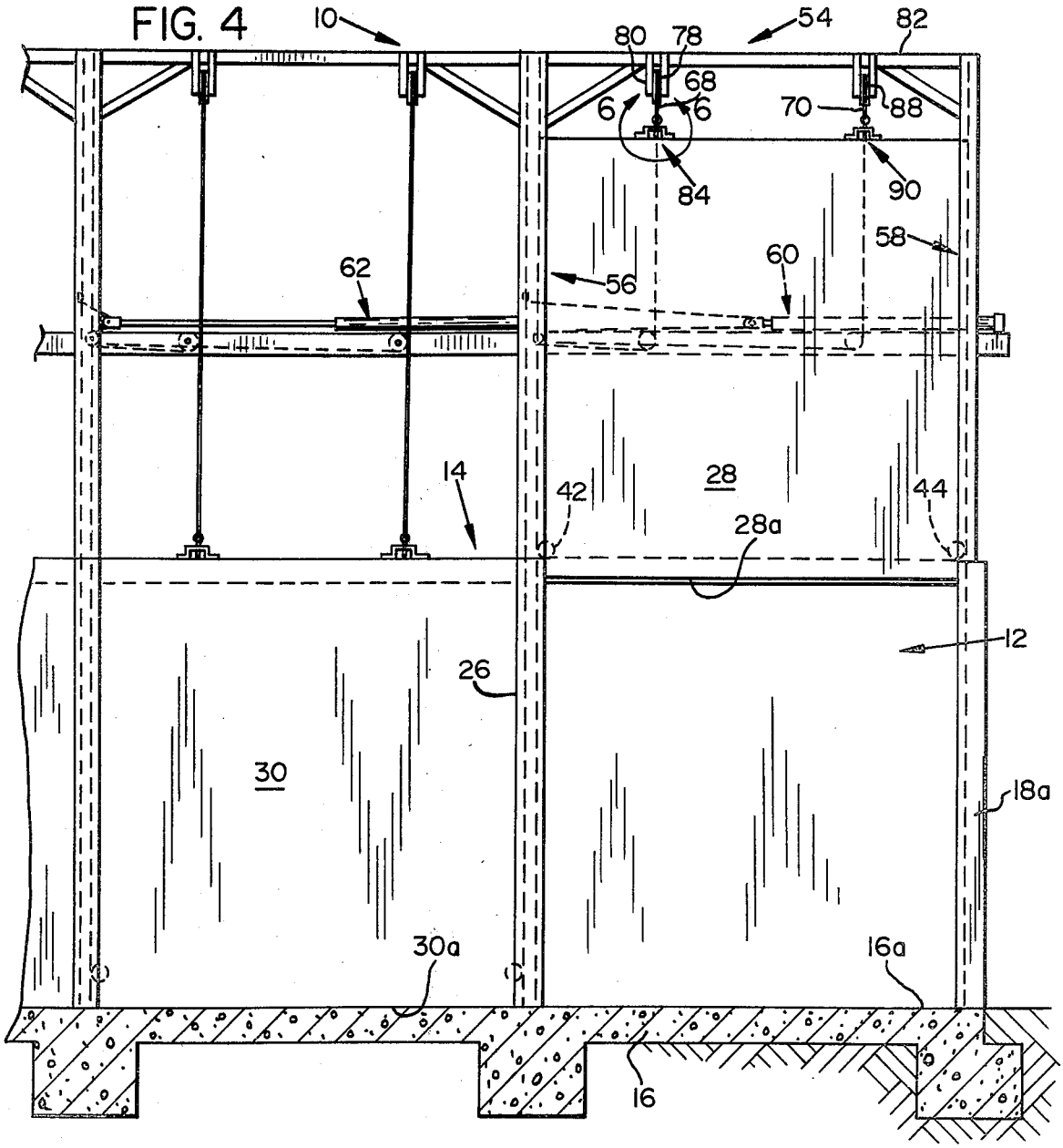
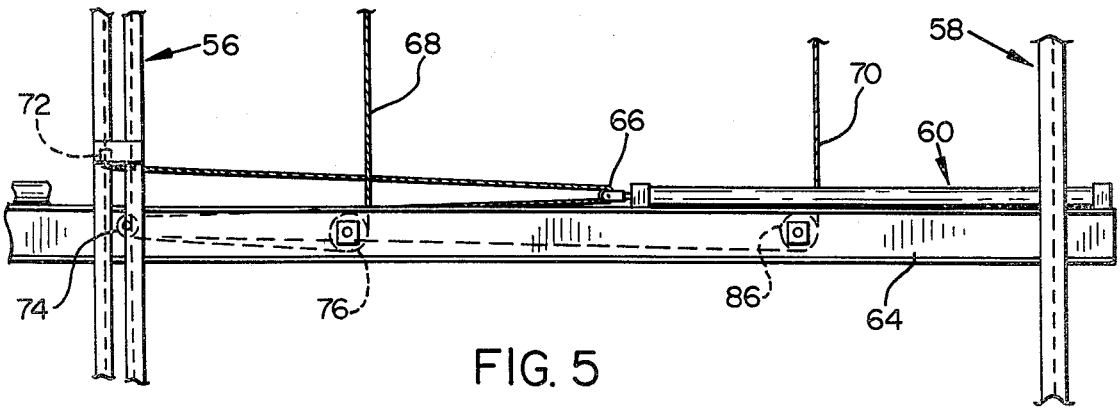
FIG. 5

VENEER BLOCK MOISTURIZING APPARATUS

BACKGROUND AND SUMMARY OF THE INVENTION

This invention pertains to pre-peeling of veneer block moisturizing, and more particularly, to a novel vault construction useable for such an operation.

In preparing a block for veneer peeling, it is customary to place the block in what is known as a steam vault, wherein it is subjected to steam until it has absorbed a certain amount of moisture and heat, as determined empirically over the years for different kinds of woods. A reason for this is that such an operation improves significantly the quality of veneer, and increases what is known as the overrun recovery yielded from blocks.

Steam or moisturizing vaults in the past have typically taken the form of elongated cavities wherein blocks to be moisturized are placed and subjected to steam and/or heated water. In the past, typical methods of introducing steam and water have included direct injection via overhead nozzles, as well as injection of steam upwardly from floor level. Steam has also been used in at least one other way, namely, via a heat exchanger to create a hot water bath which is sprayed on the blocks in a vault.

Such methods of moisturizing have proved, for many reasons, to be extremely costly, ineconomic, and time-consuming. Apart from the specific prior art manners of steaming or moisturizing, which themselves require huge volumes of heated steam and water, an attendant and significant problem has been the lack of an adequate steam or moisture barrier adjacent the opening to a vault through which access is gained. For example, it is common in prior art vaults simply to have such an opening closed off by a loose flap of a fabric material, such as canvas. Another kind of closure often takes the form of a multi-panel, hinged, "garage-like" overhead door. In other words, not much attention has been paid to the need to avoid significant steam leakage and loss through a vault's opening. While significant steam loss is important to avoid, it is also important that a vault not be so tightly sealed that dangerous pressures build up inside. Thus, it is desirable to produce a moisture seal for a vault opening which both maximizes the containment of steam in the vault, and minimizes the likelihood of a dangerous pressure buildup.

A general object of the present invention is to provide a unique vault construction usable for the purpose above mentioned, which construction takes the above-referred-to concerns into consideration in an extremely practical and satisfactory manner.

More particularly, an object of the invention is to provide a vault having an opening which is exposed and closed off through what might be thought of as a guillotine-like rigid panel, or door, that slides vertically in a pair of upright lateral confronting channels.

Another object of the invention is to provide such a vault wherein the base of its opening is defined by a specially prepared smooth surface, such as a smoothly troweled cement apron, on which the base of the door, with the same closed, rests in close conformity.

A related object is to provide such a vault construction wherein the door is raised and lowered through laterally spaced lift apparatus, each of which accommodates vertical adjustment therein in order to angulate door in such a manner as to assure proper seating on the base apron when the door is closed.

Cooperating with the vault opening structure just briefly mentioned, the apparatus of the invention also features a moisturizing system wherein moisturizing is accomplished through the overhead injection into the vault, of a blend produced by the controlled mixing of steam and cold water. Such an injection technique has been found to prove to be both extremely effective in moisturizing blocks in a vault, and to be notably efficient from an energy and water-consumption standpoint in comparison with prior art moisturizing approaches.

Using vault apparatus constructed as generally outlined above, several significant advantages over prior art apparatus are found to exist. For example, and considering a typical prior art vault of a given size having a charge of Douglas fir blocks, a typical requirement for heated steam calls for a water usage rate of between about 400 and about 600-gallons-per-hour. Further, moisturizing times in the past typically lie in the range of about 8 to about 14-hours. By way of comparison, with a vault of substantially the same size constructed in accordance with the present invention, and holding a like charge of blocks, water-flow requirements are more typically about 7-gallons-per-hour, and total moisturizing times reside in the range of about 4 to 6-hours.

Thus, not only does the apparatus of the invention significantly reduce water resource requirements, and hence heating energy requirements, but also greatly minimizes what is known as the "cooking" time for a charge of blocks.

These and other objects and advantages which are attained by the invention will become more fully apparent as the description which now follows is read in conjunction with the accompanying drawings.

DESCRIPTION OF THE DRAWINGS

FIG. 1 is a fragmentary top plan view of a veneer block moisturizing installation including a plurality of moisturizing vaults, each constructed in accordance with the present invention.

FIG. 2 is a fragmentary side elevation taken from the lower side of FIG. 1.

FIG. 3 is an enlarged fragmentary top section view showing opposite sides of the front of one of the vaults in the installation of FIGS. 1 and 2, and also showing an access opening, and the closure panel, provided for the vault.

FIG. 4 is a fragmentary front elevation of the installation of FIGS. 1 and 2, taken generally along line 4—4 in FIG. 2, and employing a scale larger than that in FIG. 2.

FIG. 5 is a fragmentary front elevation, on a scale larger than FIG. 4, illustrating mechanism employed in the invention to lift a closure panel for a vault.

FIG. 6 is an enlarged fragmentary detail taken generally in the region indicated by curved line 6—6 in FIG. 4.

DETAILED DESCRIPTION OF THE INVENTION

Figure 8:
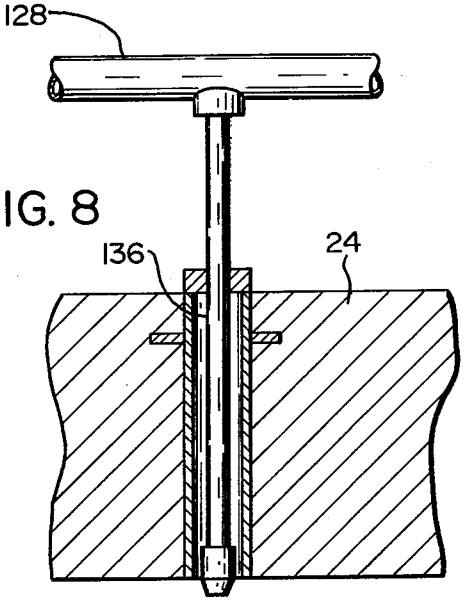
FIG. 8 is a greatly enlarged fragmentary detail, taken generally along line 8—8 in FIG. 7, illustrating an overhead nozzle which is used in moisturizing system of FIG. 7.

Turning now to the drawings, and referring first to FIGS. 1–4, inclusive, indicated generally at 10 is a veneer block moisturizing installation including plural elongated vaults, such as the two shown at 12, 14, which are constructed in accordance with the present invention. While any number of such vaults could be included in a particular situation, installation 10 includes four vaults arranged in side-by-side juxtaposition. Each vault has an overall length of slightly less than 100-feet, a width of about 12-feet, and a height of about 16-feet. Different dimensions could, of course, be used to suit different circumstances.

The several vaults in installation 10 include a common concrete base 16, and are defined by lateral concrete walls, such as walls 18, 20, a common concrete back wall 22 and a common concrete roof 24. These elements in the vault installation are typically suitably reinforced, and are joined in any suitable conventional manner. Where they join, the respective joints form a moisture barrier for the associated vaults.

As can be seen for wall 18, the two lateral outside walls in installation 10 extend forwardly from the fronts of the vaults in upright projections, such as projection 18*a*, to provide pillar-like reinforcement adjacent the front outer sides of the installation. Intermediate these projections, and in line with each of the three interior walls, are reinforced concrete pillars, such as pillar 26 associated with wall 20, which likewise provide frontal support for the installation. As can be seen, concrete base 16 extends beneath and forwardly beyond the pillar-like structures in installation 10. Where this base extends beneath the front openings in the vaults, the same forms an apron which is specially surfaced to function in a manner which will be described shortly. More particularly, the apron in bases 16, which apron is shown at 16*a*, where it extends past the upright plane defining the fronts of the vaults, is specially troweled to produce a very flat, horizontal, almost glass-like finished surface.

The front openings which are provided for the vaults are, of course, necessary to afford loading and unloading access to the vaults. However, during a moisturizing or "cooking" operations, it is important that these openings be sealed as effectively as possible against moisture loss from the vaults, without being sealed so tightly that dangerous pressures can build up in the vaults.

According to an important feature of the invention, and referring now more particularly to FIGS. 3 and 4, provided for exposing and closing each of the vault openings are rigid unitary panels, or doors, such as the doors shown at 28, 30 provided for vaults 12, 14, respectively. In FIG. 3, both of these doors are shown in positions closing the openings to their respective associated vaults. In FIG. 4, door 28 is shown open and door 30 closed.

With reference particularly to door 28—each of the doors being constructed in a substantially identical manner—this door includes a frame having lateral upright side members 32,34, which take the form of hollow rectangular tubes. These side members are joined by a plurality of transverse members (not shown) to rigidify the frame. Secured to and spanning both sides of the frame are surfacing sheets 36, 38 which are formed of a suitable material such as sheet steel. Mounted on the outside corners of side frame members 32, 34, and extending therealong vertically, are angle members such as those shown at 40. Finally, mounted near the bases of side members 32, 34 are rollers 42, 44, respectively. These rollers are largely disposed within the hollow interiors of the side members, but have their outer perimetral portions extending beyond the margins of the door through suitable accommodating openings provided in members 32, 34.

The doors in installation 10 operate in what might be thought of as a guillotine-like fashion. More particularly, the doors are mounted for vertical shifting in spaced opposed channels which define the opposite sides of each vault opening. With reference particularly to the opening for vault 12, as seen in FIG. 3, the opposite sides of this opening are defined by channels formed by two sets of angle members shown at 46, 48. Angle members 46 define the left side of the opening in FIG. 3, and angle members 48 define the right side of the opening in the figure. As can be seen, these angle members are suitably embedded in the forward portion of the concrete structure described earlier. Further, extending vertically along angle members 46 is a guide strip 50, and similarly extending along members 48 is a guide strip 52.

As can be seen, the lateral margins of door 28 are snugly yet with adequate clearance, received in the channels defined by members 46, 48. Rollers 42, 44 are positioned to ride on the confronting faces of strips 50, 52.

Referring to FIGS. 2 and 4, extending upwardly adjacent the fronts of the vaults is an overhead frame structure 54 which carries plural upright channel extensions, such as those shown at 56, 58 which are formed with angle members and guide strips like those previously described. These channel extensions extend sufficiently far above the roof in installation 10 to allow raising of the vault doors to positions completely exposing the vault openings. This is clearly illustrated in FIG. 4, where door 28 is shown so raised.

Provided for each of the vaults, for lifting the associated doors, are hydraulic cylinders, such as cylinders 60, 62, which are provided for doors 28, 30, respectively. Considering FIG. 5 along with FIG. 4, cylinder 60 is mounted in any suitable fashion on a transverse frame bar 64 which forms part of structure 54. The cylinder is located as shown toward the right side of vault 12. Its rod end carries a double pulley 66. Acting between the cylinder and the door are two cables 68, 70. Considering FIGS. 4 and 5 together, the lower end of cable 68 is anchored at 72 on channel extension 56, slightly above frame bar 64. From this end, cable 68 extends over one track in pulley 66, thence around one track in another double pulley 74 which is journaled near the intersection between channel extension 56 and frame bar 64, thence around a pulley 76 which is journaled on bar 64, and thence around an overhead pulley 78 (see FIG. 4). Pulley 78 is journaled on a mounting 80 which is carried on and below a transverse member 82 that forms part of frame structure 54. The upper end of cable 68 is secured to the upper left side of door 28 in FIG. 4 by an assembly shown generally at 84, the details of which will be explained shortly.

The lower end of cable 70 is also secured by anchor 72, and from this anchor, extends around the other tracks in pulleys 66, 74, thence around a pulley 86 which, like pulley 76 is mounted on frame bar 64, but toward the right side of this bar in FIG. 5, thence upwardly and around an overhead pulley 88 which is supported much like pulley 78, except toward the right side of transverse member 82 in FIG. 4. The upper end of cable 70 is secured to the upper right side of door 28 in FIG. 4 through an assembly 90 which is substantially identical in construction to assembly 84.

Considering now the construction of assembly 84, and referring particularly to FIG. 6, this assembly includes an inverted generally U-shaped bracket 92, which is affixed as by welding to the top of the frame in door 28, an eye bolt 94, which is received in a suitable accommodating bore provided in bracket 92, and a pair of nuts 96, 98, which are threaded onto the shank in the eye bolt. The upper end of cable 68, previously mentioned, is suitably secured in the eye of bolt 94.

According to a feature of the invention, cable mounting assemblies 84, 90 are located substantially symmetrically with respect to the vertical centerline of door 28.

Completing a description of purely mechanical aspects of the invention, the undersides of the frames in the vault doors are preferably formed to extend along as straight a line as possible. The undersides of the frames for doors 28, 30 are shown in FIG. 4 at 28*a*, 30*a*, respectively. Attention to establishing this kind of straight line shape for the undersides of the door frames, as well as attention to flat and horizontal smooth finishing for apron 16*a* where the same extends through a door opening, enables the doors, when in closed positions, to provide effective moisture barriers adjacent the bases of the vault openings. In FIG. 4, where door 30 is shown in a closed position, the closely conforming fit between door frame underside 30*a* and apron 16*a* is clearly evident.

Cooperating to achieve such matching conformity, both at the time of construction, and later on when changes occur in the lengths of the lifting cables for the doors, are mounting assemblies 84, 90 provided for the upper ends of the cables. More particularly, through adjusting the positions of the screws on the eye bolts, it is possible to provide for lateral angulation of a door so as to adjust for parallelism between its underside and the underlying portion of apron 16*a*. When such an adjustment is properly made, raising and lowering of a door takes place with the underside of the door remaining properly positioned in parallel relation with respect to the underlying apron.

It will be obvious that raising of a door is accomplished by contraction of the associated cylinder, and lowering of the door by extension of the cylinder. Such raising and lowering results in the door sliding vertically in the channels and channel extensions, with the rollers provided for the doors riding on the guide strips to provide for low-friction, non-binding travel.

Figure 7:
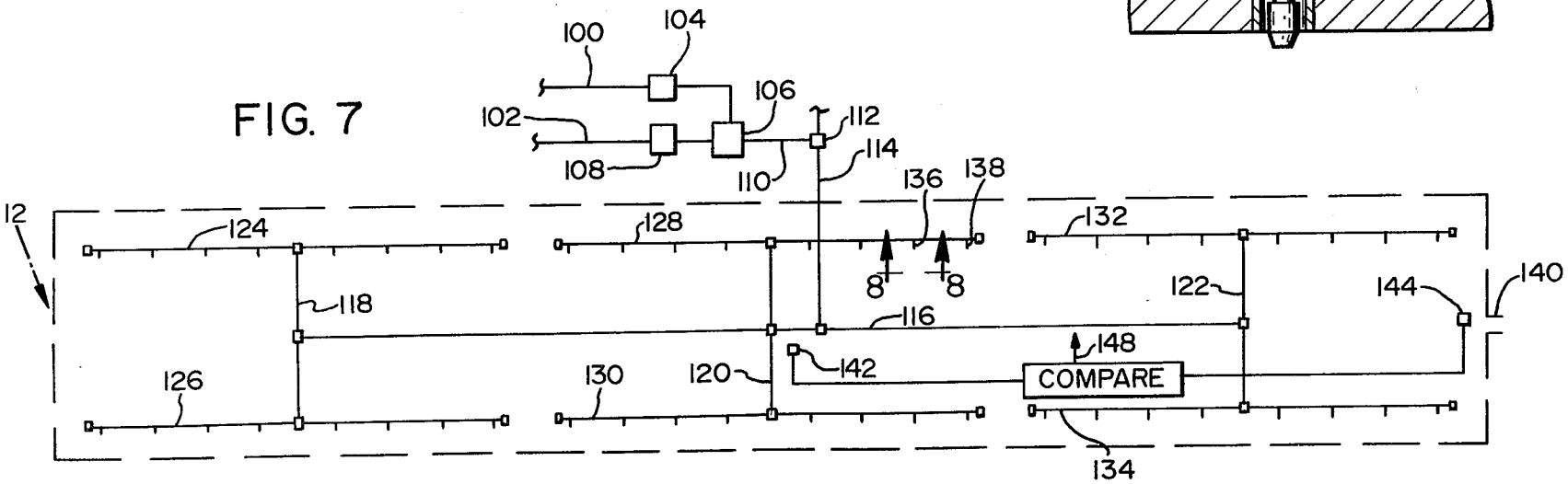
FIG. 7 is a simplified and very schematic top plan view illustrating a moisturizing conduit system used in the installation of FIGS. 1 and 2.

Turning attention now FIGS. 7 and 8. These illustrate a in very simplified and schematic form, a portion of a moisturizing system which is used in vault installation 10. In FIG. 7, the view generally presented there is an overhead plan view looking at vault 12, which is represented by the dashed lines in the figure. According to an important feature of the invention, moisturizing of a charge of blocks in a vault in installation 10 takes place through introducing both steam and cold water in the moisturizing sytem. Accordingly, included in the apparatus of the invention are a main steam conduit 100, and a main cold water conduit 102. These two conduits, as well as all other conduits in the moisturizing system, with the exception of the injection nozzles are located on the top of roof 24.

Steam in conduit 100 is supplied at a temperature of about 350° to 390° F., and feeds into the moisturizing system through a main control and regulating valve assembly 104 and a blending valve 106. The valving mechanism used in assembly 104, as well as the mechanism employed in blending valve 106, is completely conventional in construction, and forms no part, per se, of the present invention. Water in conduit 102 is supplied at ambient temperature (typically about 40° F.) to blending valve 106 through a control and regulating valve assembly 108 which is similar in many respects to assembly 104. Through a conduit 110 and a fitting 112, the blend of water and steam is introduced to a main header 114 which functions to distribute the blend to four different subheader systems, each of which is associated with a different one of the vaults in installation 10. More particularly, and with reference to the subheader system associated with vault 12, the same includes a longitudinal conduit 116 and three transverse conduits 118, 120, 122. Each transverse conduit, in turn, feeds two other conduits which extend longitudinally relative to, and on opposite sides of, vault 12. Thus, connected to transverse conduit 118 are conduits 124, 126, connected to transverse conduit 120 are conduits 128, 130, and connected to transverse conduit 122 are conduits 132, 134. Connected in turn to each of these last-mentioned conduits, at a plurality of locations distributed therealong, are downwardly extending nozzles which extend through roof 24 and into the inside of vault 12. For example, and referring to conduit 128, the same carries eight downwardly directed nozzles, two of which are shown at 136, 138. Similar nozzles, in similar numbers, are carried by each of the other five conduits (for vault 12) which are like conduit 128.

Referring for a moment to FIG. 8, this illustrates in detail how nozzle 136 extends from conduit 128 through roof 24. As will be appreciated by those skilled in the art, the exact manner in which the nozzles are mounted on and extend through the roof is not critical, and could be done in a variety of ways.

Completing a description of what is shown in FIG. 7, during a moisturizing process, the steam which is introduced in vault 12 condenses to water and must be collected and drained. Represented schematically at 140 for vault 12 is a suitable drain to accommodate water discharge. Drain 140 takes the form of a discharge conduit formed at the rear end of vault 12, with base 16 sloping slightly from just inside apron 16*a* toward rear wall 22.

It is customary to determine the readiness of a moisturized charge of blocks by comparing the ambient temperature of the environment inside a vault with the temperature of drainage water which is discharging from the vault. Accordingly, provided generally centrally within vault 12, just adjacent roof 24, is a temperature sensor 142 which produces an electrical output signal which is directly related to the temperature of the atmosphere inside vault 12. Located adjacent drain 140 is another temperature sensor, 144, which produces an electrical output signal directly related to the temperature of discharged water. The signals from these two sensors are fed to a conventional comparator circuit, represented by block 146, which, on detecting an appropriate set of different temperatures, as noted by sensors 142, 144, produces on an output conductor 148 a signal to indicate the "doneness" of the moisturized charge. Experience has shown that with ambient temperature at about 190° F., readiness in a charge is indicated by drainage water reaching a temperature of about 180° F.

Explaining now how the apparatus of the invention performs, the doors for the several vaults are raised to their fully raised positions through contracting the associated cylinders. Charges of veneer blocks are loaded in the vaults to fill them, and the doors are then relowered. Because of the unique construction provided for guiding the margins of the doors, when a door is fully lowered, it acts as an extremely effective moisture barrier for the front end of its associated vault. In particular, with the lateral margins of the door fitted within the opposing channels which act as shifting guides for the door, only a minimal amount of steam escapes past these margins. The same is true with respect to the interface between the underside of the door and its associated smooth-polished apron. A close fit also exists between the upper margin of the door and roof 24—with this fit also acting as an effective moisture barrier. Naturally, the door itself, being rigid, unitary and impervious to moisture, completely prevents any steam escape through it.

Steam and water are then introduced into the moisturizing conduit system, with control taking place in valving assemblies 104, 108 to maintain the temperature of the steam/water blend, where it exits blending valve 106, at about 250° F. to 300° F. The blend which results is substantially entirely steam—the water which was injected having been converted to steam, and at the same time having cooled the originally injected steam.

Naturally, as the blend travels in the headers, and as it is injected through the nozzles into the vaults, it continues to drop in temperature, and the effect of this is that the ambient environment temperature sensors, like sensor 142, typically register a temperature of about 190° F.—a temperature which has been found to be especially effective in veneer block moisturizing. In fact, the output signal from sensor 142 and from the others like it may be directly monitored to effect control of valving assemblies 104, 108 to assure such an atmospheric temperature in the vaults.

The blend is injected by the nozzles directly over the charge of veneer blocks, and this process continues until a signal is generated by comparator circuit 148 to indicate readiness. When such a signal is generated, the flow of water and steam is shut down, and, ultimately, the vaults are opened and the charges removed.

By providing apparatus, like that which has been shown and described herein, for closing off the open end of a vault, very little steam escapes from the vault during a moisturizing operation. As a consequence, less steam, water and heat than have been needed in the past are required to perform such an operation. While steam escape is effectively prevented, pressure build-up is avoided, inasmuch as the seals provided around the doors are not pressure tight.

By introducing moisture into the system in the form of a blend of steam and cold water, in cooperation with sealing a vault against substantial steam loss, complete moisturizing can be accomplished in extremely short time intervals as compared with prior art time intervals.

While a particular construction has been shown, variations may be made to suit different special requirements or circumstances. For example, while cylinders have been provided herein for raising and lowering the doors, winches could as well be used—each handling a pair of cables like cables 68, 70. Also, and as a safety feature, it may be desirable to equip each door with a sealed, small pop-out panel as an emergency escape hatch for a person accidentally trapped in a vault.

Thus, while a preferred embodiment of the invention has been described herein, and certain modifications suggested, it is appreciated that other variations and modifications may be made without departing from the spirit of the invention.

It is claimed and desired to secure by Letters Patent:

1. Veneer block moisturizing apparatus comprising means defining a vault having an upright opening for receiving such a block, said opening being bounded on opposite lateral sides by confronting moisture-sealing channels, a rigid closure panel for exposing and closing said opening, said panel including opposite lateral margins slidably and sealingly received in said channels, and moisturizing means communicating with the inside of said vault, said moisturizing means including a first conduit system adapted to carry steam, a second conduit system adapted to carry water, and a blending discharge system operatively connected to said first and second conduit systems for receiving therefrom, and blending, steam and water, and for discharging such blend into said vault.

2. The apparatus of claim 1 which further includes an elongated moisture-sealing apron defining the base of said opening and having a shape along its length conforming to the shape of the base margin of said panel, and laterally spaced lift means attached to said panel for shifting the same vertically relative to said apron, said lift means accommodating adjustment of the relative vertical positions of said panel's said lateral margins.

3. Veneer block moisturizing apparatus comprising means defining a vault having an upright opening for receiving such a block, a rigid closure panel for exposing and closing said opening, means mounting said panel for substantially vertical shifting relative to said opening, sealing means adjacent opposite sides of said opening adapted to cooperate with lateral margins in said panel, with the latter closing said opening, to provide a moisture barrier between said opening and said panel, and moisturizing means communicating with the inside of said vault, said moisturizing means including a first conduit system adapted to carry steam, a second conduit system adapted to carry water, and a blending discharge system operatively connected to said first and second conduit system for receiving therefrom, and blending, steam and water, and for discharging such blend into said vault.

4. The apparatus of claim 3 which further includes an elongated moisture-sealing apron defining the base of said opening and having a shape along its length conforming to the shape of the base margin of said panel, and laterally spaced lift means attached to said panel for shifting the same vertically relative to said apron, said lift means accommodating adjustment of the relative vertical positions of said panel's said lateral margins.

* * * * *